US007507184B2

(12) United States Patent
Rodgers, Jr.

(10) Patent No.: US 7,507,184 B2
(45) Date of Patent: Mar. 24, 2009

(54) EXERCISE DEVICE WITH FLEXIBLE SUPPORT ELEMENTS

(76) Inventor: Robert E. Rodgers, Jr., 974 Kings Point Dr., Canyon Lake, TX (US) 78133

( * ) Notice: Subject to any disclaimer, the term of this patent is extended or adjusted under 35 U.S.C. 154(b) by 457 days.

(21) Appl. No.: 11/388,845

(22) Filed: Mar. 24, 2006

(65) Prior Publication Data

US 2006/0217234 A1 Sep. 28, 2006

Related U.S. Application Data

(60) Provisional application No. 60/665,268, filed on Mar. 25, 2005, provisional application No. 60/676,833, filed on May 2, 2005.

(51) Int. Cl.
*A63B 22/00* (2006.01)
*A63B 22/06* (2006.01)

(52) U.S. Cl. ..... 482/52; 482/51; 482/57

(58) Field of Classification Search ..... 482/51–53, 482/57, 62, 70, 79–80
See application file for complete search history.

(56) References Cited

U.S. PATENT DOCUMENTS

| | | | | |
|---|---|---|---|---|
| 1,166,304 | A | 12/1915 | Albert | |
| 3,756,595 | A | 9/1973 | Hague et al. | |
| 4,869,496 | A | 9/1989 | Colombo et al. | |
| 4,940,233 | A | 7/1990 | Bull et al. | |
| 5,299,993 | A * | 4/1994 | Habing | 482/52 |
| 5,611,756 | A | 3/1997 | Miller | |
| 5,735,773 | A | 4/1998 | Vittone et al. | |
| 5,795,268 | A | 8/1998 | Husted | |
| 5,910,072 | A | 6/1999 | Rawls et al. | |
| 5,967,944 | A | 10/1999 | Vittone et al. | |
| 5,989,163 | A | 11/1999 | Rodgers, Jr. | |
| 6,004,244 | A | 12/1999 | Simonson | |
| 6,036,622 | A | 3/2000 | Gordon | |
| 6,045,487 | A | 4/2000 | Miller | |
| 6,113,518 | A | 9/2000 | Maresh et al. | |
| 6,123,650 | A | 9/2000 | Birrell | |
| 6,152,859 | A | 11/2000 | Stearns | |
| 6,165,107 | A | 12/2000 | Birrell | |
| 6,340,340 | B1 | 1/2002 | Stearns et al. | |
| 6,579,210 | B1 | 6/2003 | Stearns et al. | |
| 6,626,802 | B1 | 9/2003 | Rodgers, Jr. | |
| 6,689,019 | B2 | 2/2004 | Ohrt et al. | |
| 6,726,600 | B2 | 4/2004 | Miller | |
| 6,761,665 | B2 | 7/2004 | Nguyen | |

(Continued)

OTHER PUBLICATIONS

U.S. Appl. No. 60/780,599, filed Mar. 9, 2006, Rodgers, Jr.

*Primary Examiner*—Steve R Crow
(74) *Attorney, Agent, or Firm*—Fulbright & Jaworski L.L.P.

(57) ABSTRACT

A stationary exercise device with flexible support elements may include a frame with a base portion. A crank system with crank arms is coupled to and supported by the frame. Right and left pivotal linkage assemblies may each have an arcuate motion member and a foot support member. The arcuate motion member may be coupled to the frame. The foot support member may be coupled to the arcuate motion member. The arcuate motion member may be oriented in a generally vertical position and the foot support member may be oriented a generally horizontal position. Flexible element coupling systems couple the right and left foot support members to the crank system.

34 Claims, 6 Drawing Sheets

U.S. PATENT DOCUMENTS

| | | | |
|---|---|---|---|
| 6,926,646 | B1 | 8/2005 | Nguyen |
| 2001/0012811 | A1 | 8/2001 | Gordon |
| 2002/0094914 | A1 | 7/2002 | Maresh et al. |
| 2004/0058784 | A1 | 3/2004 | Roberts |
| 2004/0077463 | A1 | 4/2004 | Rodgers |
| 2004/0235621 | A1 | 11/2004 | Eschenbach |
| 2004/0248708 | A1 | 12/2004 | Rodgers |
| 2004/0248709 | A1 | 12/2004 | Rodgers |
| 2005/0049117 | A1 | 3/2005 | Rodgers, Jr. |
| 2005/0124466 | A1 | 6/2005 | Rodgers, Jr. |
| 2005/0124467 | A1 | 6/2005 | Rodgers, Jr. |
| 2006/0217234 | A1 | 9/2006 | Rodgers, Jr. |

* cited by examiner

EXERCISE DEVICE WITH FLEXIBLE SUPPORT ELEMENTS

PRIORITY CLAIM

This application claims priority to U.S. Provisional Patent Application Ser. No. 60/665,268 filed on Mar. 25, 2005 entitled "PENDULUM STRIDING EXERCISE DEVICE" and Ser. No. 60/676,833 filed on May 2, 2005 entitled "PENDULUM STRIDING EXERCISE DEVICE", the disclosures of which are hereby incorporated by reference.

FIELD OF THE INVENTION

The present invention relates generally to an exercise device and more particularly it relates to an exercise device with flexible support elements. The exercise device provides exercise such as simulated walking, striding, jogging, or climbing that more accurately simulates these activities than currently available exercise equipment.

BACKGROUND OF THE INVENTION

It can be appreciated that exercise devices have been in use for years. Typical of exercise devices that simulate walking or jogging are cross country ski machines, elliptic motion machines, and pendulum motion machines. Typical exercise devices that simulate climbing are reciprocal stair climbers.

Ellliptic motion exercise machines provide inertia that assists in direction change of the pedals, which makes the exercise smooth and comfortable. However, rigid coupling to a crank typically constrains the elliptic path to a fixed length. Therefore, the elliptic path may be too long for shorter users, or too short for tall users. Further, a running stride is typically longer than a walking stride, so a fixed stride length does not ideally simulate all weight bearing exercise activities. Therefore, typical elliptic machines cannot optimally accommodate all users. Some pendulum motion machines may allow variable stride length, but the user's feet typically follow the same arcuate path in both forward and rearward motion. Such a motion does not accurately simulate walking, striding, or jogging, where the user's feet typically lift and lower. Reciprocal stair climbers typically allow the user to simulate a stepping motion, but that motion is generally constrained to a vertically oriented arcuate path defined by a linkage mechanism. Such a motion does not accurately simulate a wide range of real world climbing activities such climbing stairs or climbing sloped terrain.

What is needed is an exercise device that overcomes some or all of the above-described disadvantages of the designs of the prior art, and provides a user with the advantages of variable stride length and more accurate simulation of real world activities.

SUMMARY OF THE INVENTION

The invention relates to a stationary exercise device with flexible support elements. In one aspect, the exercise device includes a frame with a base portion that is supported by the floor. A crank system with crank arms is coupled to and supported by the frame. The crank system may be coupled to a brake inertia/device. Right and left pivotal linkage assemblies may each have an arcuate motion member and a foot support member. The arcuate motion member may be coupled to the frame. The foot support member may be coupled to the arcuate motion member. The foot support member may include foot plates. The arcuate motion member may have an upper portion that acts as a handle. The arcuate motion member may be oriented generally vertical and the foot support member may be oriented generally horizontal. Flexible element coupling systems couple the right and left foot support members to the crank system. In this manner, rotation of the crank system alternately lifts and lowers the foot support members.

In one aspect, the right and left pivotal linkage assemblies of a stationary exercise device are cross coupled so that motion of one foot support member causes an opposing motion of the other foot support member. In this manner, a forward motion of one foot support member results in a rearward motion of the other foot support member.

In one aspect, a crank system may be located generally behind the user. A flexible support element may be attached to a generally rearward portion of a foot support member. An arcuate motion member may be coupled to a generally forward portion of the foot support member.

In another aspect, a crank system may be located generally ahead of the user. A flexible support element is attached to a generally forward portion of a foot support member. An arcuate motion member is coupled to a generally rearward portion of the foot support member.

In another aspect, a flexible support element is attached to the foot support member near the foot pedal.

In another aspect, additional links of an exercise apparatus may provide additional lateral positioning of the foot support members.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF ILLUSTRATIVE EMBODIMENTS

In the following detailed description, reference is made to the accompanying drawings, in which are shown by way of illustration specific embodiments of the present invention. It should be understood that the detailed description and specific examples are intended for purposes of illustration only and are not intended to limit the scope of the invention. Numerous changes, substitutions, and modifications may be made without departing from the scope of the present invention.

Figure 1:
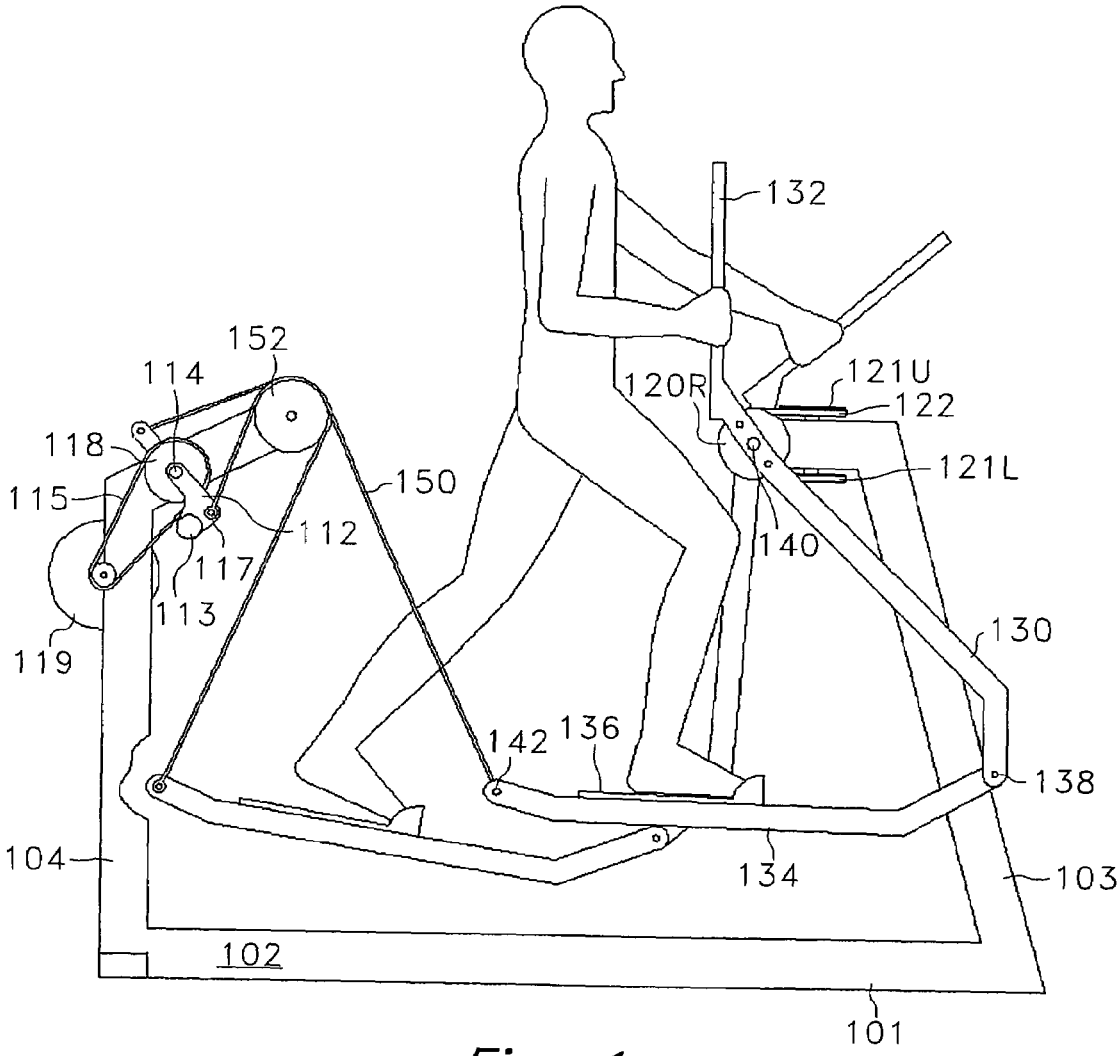
FIG. 1 depicts a side view of an embodiment of an exercise device.
Figure 2:
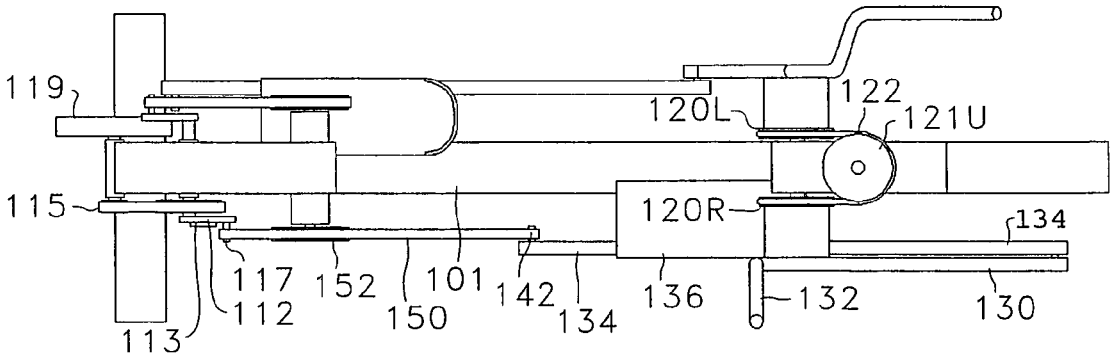
FIG. 2 depicts a top view of an embodiment of an exercise device.

FIG. 1 shows a side view of an embodiment. FIG. 2 shows a top view of the embodiment of FIG. 1. Frame 101 includes a basic supporting framework including base 102 and has front and rear upper stalks 103, 104. The lower portion of base 102 engages and is supported by the floor. A crank system may include crank members 112 attached to crank shaft 114. Although only one crank arm is numbered, it is understood that there is an opposing crank arm. Crank shaft 114 is supported by frame 101 so that the crank shaft may rotate about its longitudinal axis. One of the crank arms may include counterweight 113. Although the embodiment shown in FIG. 1 utilizes a crank shaft with crank arms, other crank system configurations can be utilized. For example, some crank systems may have more than two crank arms. Still other crank systems may forego crank arms and utilize a ring supported and positioned by rollers with a pivotal attachment point at or near the periphery of the ring. The pivotal attachment point may function as a crank arm.

The crank system may also include brake/inertia device 119 coupled to the crankshaft through belt 115 and pulley 118. Rotation of crank arms 112 about the axis of crankshaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation. Although the embodiment shown in FIG. 1 uses a single brake/inertia device, it is possible to utilize multiple brake/inertia devices or to separate the braking and inertia functions between two or more devices.

A pivotal linkage assembly may include arcuate motion member 130 and foot support member 134. Although only the elements of the right side pivotal linkage assembly are numbered, it is understood that there is a left side pivotal linkage assembly with comparable elements. In the context of this specification, the term "member" includes a structure or link of various sizes, shapes, and forms. For example, a member may be straight, curved, or a combination of both. A member may be a single component or a combination of components coupled to one another. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Coupling may be accomplished with a pivotal pin connection as shown in FIG. 1, but coupling may also be accomplished with any device that allows relative rotation between the arcuate motion member 130 and foot support member 134. As used herein, the term "coupling" or "coupled" includes a direct coupling or an indirect coupling. Arcuate motion member 130 is coupled to frame 101 at coupling location 140. Coupling may be accomplished with shaft and bushing as shown in FIG. 1, but coupling may also be accomplished with any device that allows rotation of arcuate motion member 130 relative to frame 101. Although the embodiment shown in FIG. 1 uses a linkage assembly with two links, it will be understood that linkage assemblies in other embodiments may include more than two links.

As shown in FIG. 1, the portion of arcuate motion member 130 coupled to frame 101 is above the portion of arcuate motion member 130 coupled to foot support member 134. In the context of this specification, one element is "above" another element if it is higher than the other element. The term "above" does not require that an element or part of an element be directly over another element. Conversely, in the context of this specification, one element is "below" another element if it is lower than the other element. The term "below" does not require that an element or part of an element be directly under another element.

A flexible element coupling system may include flexible element 150. Flexible element 150 may be a belt, a cog belt, a chain, a cable, or any flexible component able to carry tension. Flexible element 150 may have some compliance in tension, such as a rubber belt, or it may have little compliance in tension, such as a chain. At one end, flexible element 150 couples to foot support member 134 at coupling location 142. At its other end, flexible element 150 couples to crank arm 112 at location 117. Flexible element 150 engages guide element 152. Guide element 152 may be any component that can guide or support a flexible element such as a pulley, a cog belt pulley, a sprocket, a roller, or a slide block.

Figure 3A:
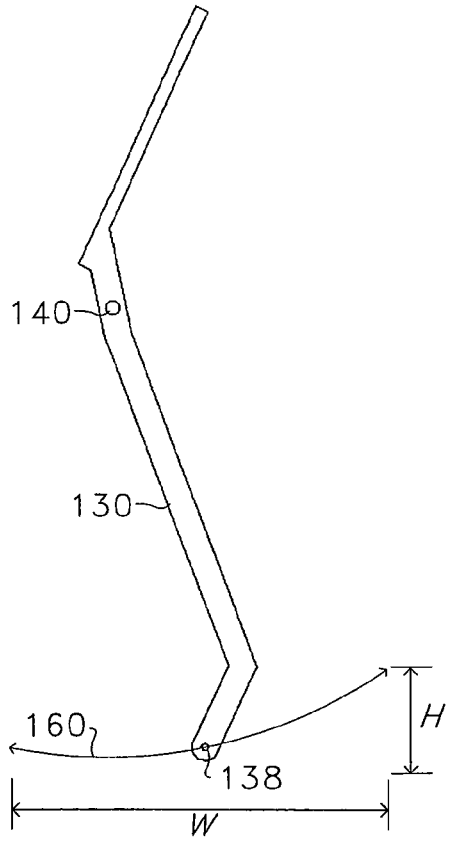
FIG. 3*a* depicts an embodiment of an arcuate motion member path.

Arcuate motion member 130 may be oriented in a generally vertical position. In the context of this specification, an element is oriented in a "generally vertical" position if the element, as measured with respect to its connection points to other elements of the system considered within the range of motion for the element, tends to be closer to vertical than horizontal. FIG. 3*a* shows an example of an arcuate motion member that is oriented in a generally vertical position. The frame of reference is fixed relative to coupling location 140. As arcuate motion member 130 moves through its range of motion about coupling location 140, coupling location 138 describes an arcuate path 160. If the width W of arcuate path 160 is greater than its height H, the arcuate motion member 130 is considered to be in a generally vertical position. It is not necessary that arcuate motion member 130 be straight, nor is it necessary that any portion be exactly vertical. Further, it is not necessary that the member be closer to vertical than horizontal at every moment during its use.

Figure 3B:
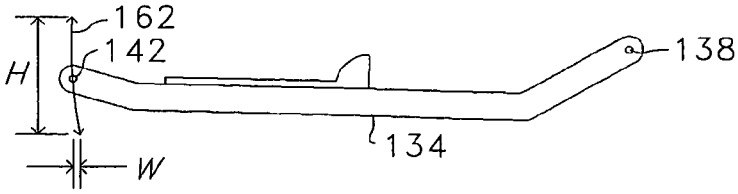
FIG. 3*b* depicts an embodiment of a foot support member path.

Foot support member 134 may be oriented in a generally horizontal position. In the context of this specification, an element is oriented in a "generally horizontal" position if the element, as measured with respect to its connection points to other elements of the system considered within the range of motion for the element, tends to be closer to horizontal than vertical. FIG. 3*b* shows an example of a foot support member that is oriented in a generally horizontal position. The frame of reference is fixed relative to coupling location 138. As foot support member 134 moves through its range of motion about coupling location 138, it describes an arcuate path 162. If the height H of arcuate path 162 is greater than its width W, the foot support member is in a generally horizontal position. It is not necessary that foot support member 130 be straight, nor is it necessary that any portion be exactly horizontal. Further, it is not necessary that the member be closer to horizontal than vertical at every moment during its use.

During operation, the user ascends the exercise device, stands on foot plates 136, and initiates a climbing motion by placing his/her weight on one of foot plates 136. As the user steps downward, force is transmitted through flexible support element 150 causing rotation of crank shaft 114 and brake/inertia device 119. As crank shaft 114 continues to rotate, foot support members 134 alternately lift and lower. This lifting and lowering motion simulates the lifting and lowering motion that a user's foot may undertake during walking, striding, jogging, and climbing. The user may instantaneously alter stride length by altering the forward and rearward force he/she applies to foot plates 136. The user may instantaneously select a nearly vertical step with little horizontal displacement, or he/she may instantaneously select a longer stride with greater horizontal displacement. When the user displaces the foot plates horizontally, the combined motions of lifting and lowering and horizontal displacement results in a closed path where the amount of horizontal displacement is instantaneously controllable by the user. Handles 132 may move in an arcuate pattern and may be grasped by the user. If the user stands stationary on foot plates 136 for an extended period of time, the crank system may settle into a locked "top dead center" condition. In such a circumstance, counterweight 113 may apply a downward force to push the crank system through the "top dead center" condition.

The right and left side pivotal linkage assemblies may be cross coupled through the left and right arcuate motion members so that the right and left foot plates 136 move in opposition. The cross coupling system may include pulleys 120R and 120L working in conjunction with idlers 121U and 121L. Belt 122 is a continuous belt that is coupled to pulleys 120R and 120L so that there is no slippage between belt 122 and pulleys 120L and 120R. Pulleys 120R and 120L are coupled to right and left arcuate motion members 130. Belt 122 causes pulleys 120R and 120L to rotate in direct opposition to one another thereby cross coupling the right and left side pivotal linkage assemblies.

Figure 4:
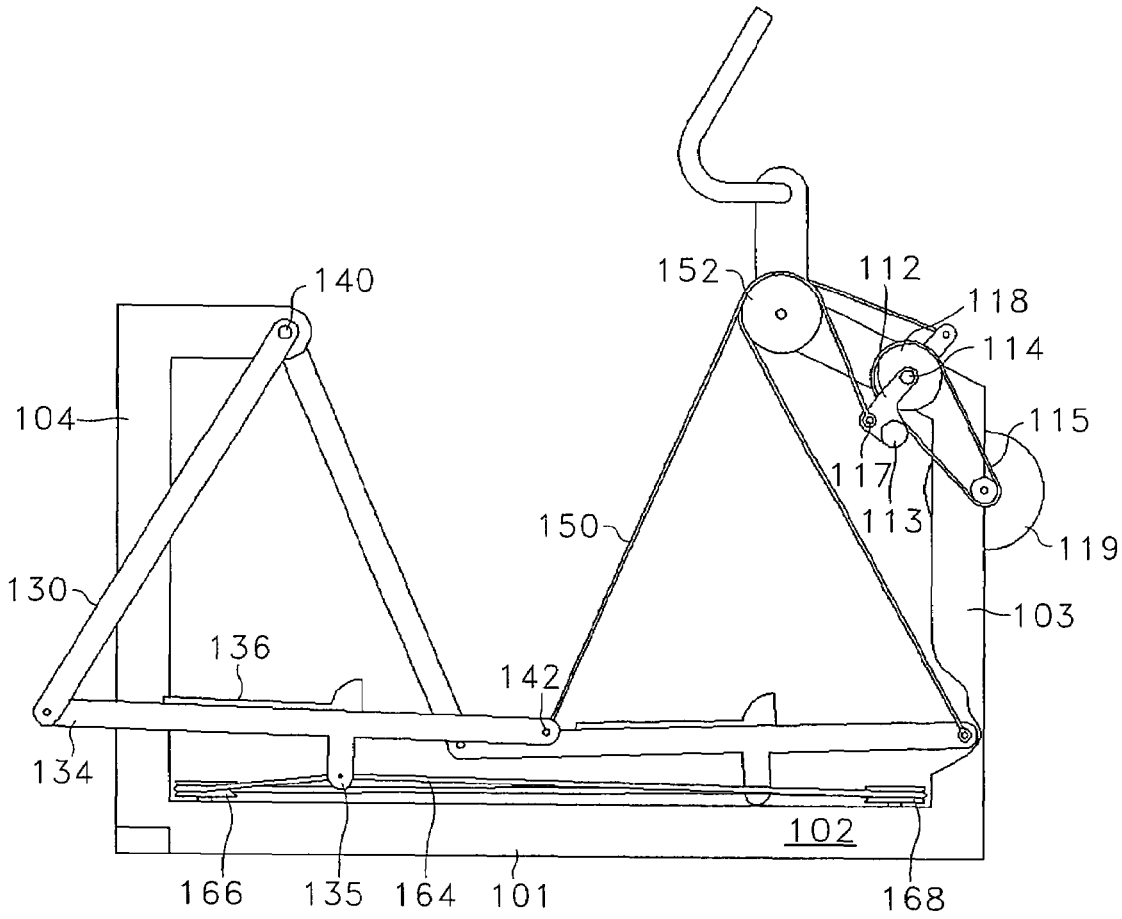
FIG. 4 depicts a side view of an embodiment of an exercise device.

FIG. 4 shows a side view of another embodiment. This embodiment has many of the same elements of the embodiments in FIGS. 1 and 2, and those elements are numbered in the same manner. This embodiment demonstrates, for example, that frame 101 may have an alternate configuration to that shown in FIG. 1, that a crank system may be mounted at an alternate location to that shown in FIG. 1, and that the arcuate motion members 130 and flexible support elements 150 may couple to foot support members 134 at alternate locations to those shown in FIG. 1.

Frame 101 includes a basic supporting framework including base 102 and front and rear upper stalks 103, 104. The lower portion of the frame engages and is supported by the floor. A crank system may include crank members 112 attached to crank shaft 114. Crank shaft 114 is supported by frame 101 so that the crank shaft may rotate about its longitudinal axis. One of the crank arms may include counterweight 113. The crank system may also include brake/inertia device 119 coupled to the crank through belt 115 and pulley 118. Rotation of crank arms 112 about the axis of crankshaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation.

A pivotal linkage assembly may include arcuate motion member 130 and foot support member 134. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Arcuate motion member 130 is coupled to frame 101 at coupling location 140.

A flexible coupling system may include flexible element 150. Flexible element 150 couples to foot support member 134 at coupling location 142. At its other end, flexible element 150 couples to crank arm 112 at location 117. Flexible element 150 engages guide element 152.

The cross coupling system includes continuous belt 164. Continuous belt 164 may engage pulleys 166 and 168. Continuous belt 164 is coupled to foot support members 134 at coupling locations 135. As one foot support member moves forward, the opposing foot support member moves rearward. Continuous belt 164 may have a slight amount of compliance that allows it to accommodate the varying geometry of the system as foot support members 134 move forward and rearward.

Operation of the embodiment shown in FIG. 4 is the same as for the embodiment in FIG. 1. The user ascends the exercise device, stands on foot plates 136, and initiates a climbing motion by placing his/her weight on one of foot plates 136. As the user steps downward, force is transmitted through flexible support element 150 causing rotation of the crank system including brake/inertia device 119. As the crank system continues to rotate, foot support members 134 alternately lift and lower. This lifting and lowering motion simulates the lifting and lowering motion that a user's foot may undertake during walking, striding, jogging, and climbing. The user may instantaneously alter stride length by altering the forward and rearward force he/she applies to foot plates 136. The user may instantaneously select a nearly vertical step with little horizontal displacement, or he/she may instantaneously select a longer stride with greater horizontal displacement. When the user displaces the foot plates horizontally, the combined motions of lifting and lowering and horizontal displacement results in a closed path where the amount of horizontal displacement is instantaneously controllable by the user.

Figure 5:
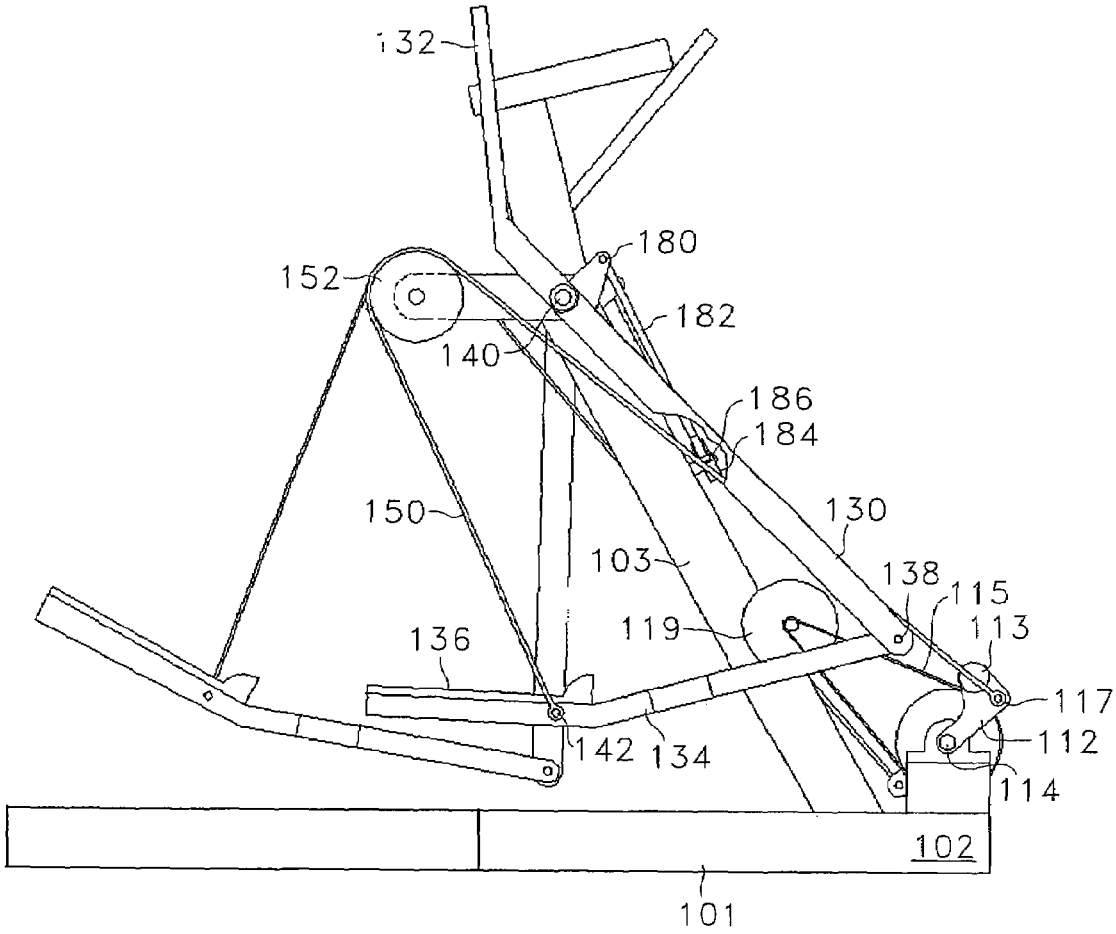
FIG. 5 depicts a side view of an embodiment of an exercise device.

FIG. 5 shows a side view of another embodiment. This embodiment has many of the same elements of the embodiments in FIGS. 1, 2, and 4, and those elements are numbered in the same manner. This embodiment demonstrates, for example, that frame 101 may have an another alternate configuration to that shown in the preceding figures, that the crank system may be mounted at an another alternate location to those shown in the preceding figures, and that arcuate motion members 130 and flexible support elements 150 may couple to foot support members 134 at other alternate locations to those shown in the preceding figures.

Frame 101 includes a basic supporting framework including base 102 and a front upper stalk 103. The lower portion of the frame engages and is supported by the floor. A crank system may include crank members 112 attached to crank shaft 114. Crank shaft 114 is supported by frame 101 so that the crank shaft may rotate about its longitudinal axis. One of crank arms 112 may include a counterweight 113. The crank system may also include brake/inertia device 119 coupled to the crank through belt 115 and pulley 118. Rotation of crank arms 112 about the axis of crankshaft 114 causes rotation of brake/inertia device 119. Brake/inertia device 119 may provide a braking force that provides resistance to the user during exercise, and/or it may provide inertia that smoothes the exercise by receiving, storing, and delivering energy during rotation.

A pivotal linkage assembly may include arcuate motion member 130 and foot support member 134. Arcuate motion member 130 has an upper portion 132. Upper portion 132 can be used as a handle by the user. Arcuate motion member 130 may be straight, curved, or bent. Foot support member 134 has foot plate 136 on which the user stands. Foot support member 134 may be straight, curved, or bent. Foot support member 134 is coupled to arcuate motion member 130 at coupling location 138. Arcuate motion member 130 is coupled to frame 101 at coupling location 140.

A flexible coupling system may include flexible element 150. Flexible element 150 couples to foot support member 134 at coupling location 142. At its other end, flexible element 150 couples to crank arm 112 at location 117. Flexible element 150 engages guide element 152.

Figure 5A:
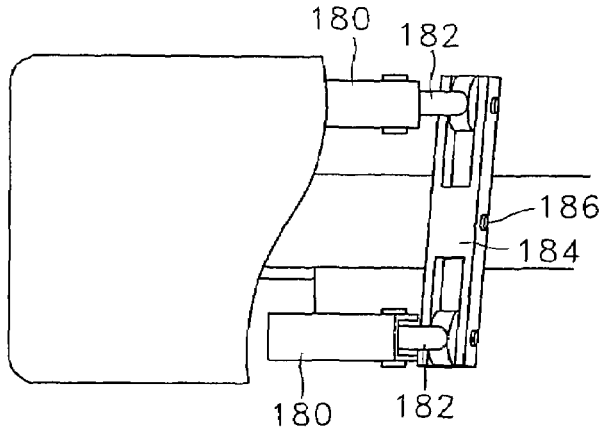
FIG. 5*a* depicts a top view of an embodiment of a cross coupling linkage.

In the embodiment shown in FIG. 5, cross coupling is accomplished with pivoting links. FIG. 5*a* depicts a top view of elements of the cross coupling system shown in FIG. 5. Elements 180 are coupled to arcuate motion members 130. Thus, each of right and left elements 180 move in unison with each right and left arcuate motion member 130, respectively. Connectors 182 couple right and left elements 180 to the right and left sides of rocker arm 184. Rocker arm 184 is pivotally coupled at its mid portion to frame 101 at location 186. As arcuate motion members 130 move, connectors 182 cause a rocking motion of rocker arm 184. This rocking motion causes right and left arcuate motion members 130 to move in opposition thus cross coupling the right and left pivotal linkage assemblies.

Operation of the embodiment shown in FIG. 5 is the same as for the embodiment in FIG. 1. The user ascends the exercise device, stands on foot plates 136, and initiates a climbing motion by placing his/her weight on one of foot plates 136. As the user steps downward, force is transmitted through flexible support element 150 causing rotation of the crank system including brake/inertia device 119. As the crank system continues to rotate, foot support members 134 alternately lift and lower. This lifting and lowering motion simulates the lifting and lowering motion that a user's foot may undertake during walking, striding, jogging, and climbing. The user may instantaneously alter stride length by altering the forward and rearward force he/she applies to foot plates 136. The user may instantaneously select a nearly vertical step with little horizontal displacement, or he/she may instantaneously select a longer stride with greater horizontal displacement. When the user displaces the foot plates horizontally, the combined motions of lifting and lowering and horizontal displacement results in a closed path where the amount of horizontal displacement is instantaneously controllable by the user.

Figure 6A:
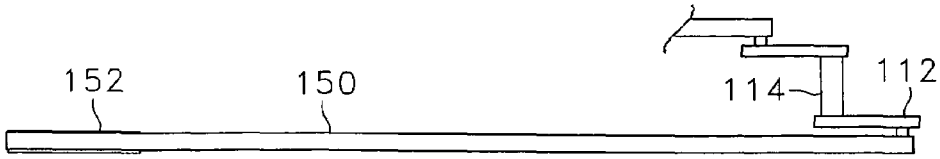
FIG. 6*a* depicts a top view of a flexible element coupling system according to one embodiment.
Figure 6B:
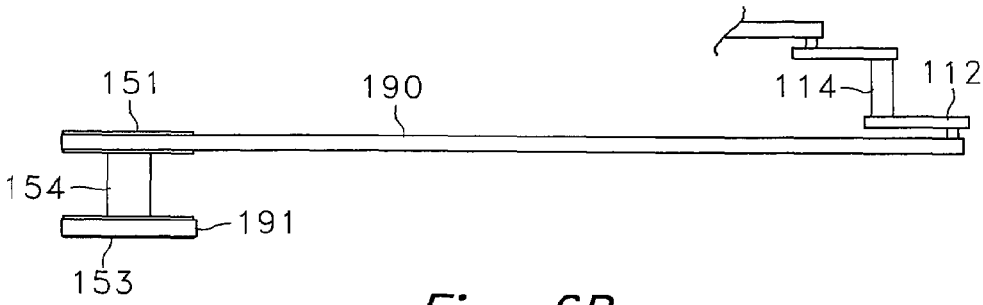
FIG. 6*b* depicts a top view of a flexible element coupling system according to another embodiment.

FIGS. 6*a* and 6*b* depict embodiments of coupling systems using flexible elements. FIGS. 6*a* and 6*b* demonstrate, for example, that the flexible element coupling system may include a single flexible element or multiple components and may directly or indirectly couple foot support members 134 to the crank system. FIG. 6*a* shows a top view of the flexible element coupling system of the embodiment in FIG. 5. This flexible element coupling system uses a single flexible element. Flexible element 150 is coupled to crank arm 112 at one end and to foot support member 134 at its other end. Flexible element 150 engages guide element 152. FIG. 6*b* shows a top view of a multiple component flexible element coupling system with indirect coupling. Flexible element 190 is coupled at one end to crank arm 112. At its other end, flexible element 190 is wrapped around and pinned to pulley 151. Pulley 151 is rigidly coupled to Pulley 153 through spool 154. Flexible element 191 is coupled at one end to foot support member 134. At its other end, flexible element 191 is wrapped around and pinned to pulley 153. As the crank system rotates, flexible element 190 alternately winds and unwinds around pulley 151, and flexible element 191 alternately unwinds and winds around pulley 153. Such a multiple component flexible element coupling system may allow more convenient routing of flexible elements through the exercise device.

Figure 7:
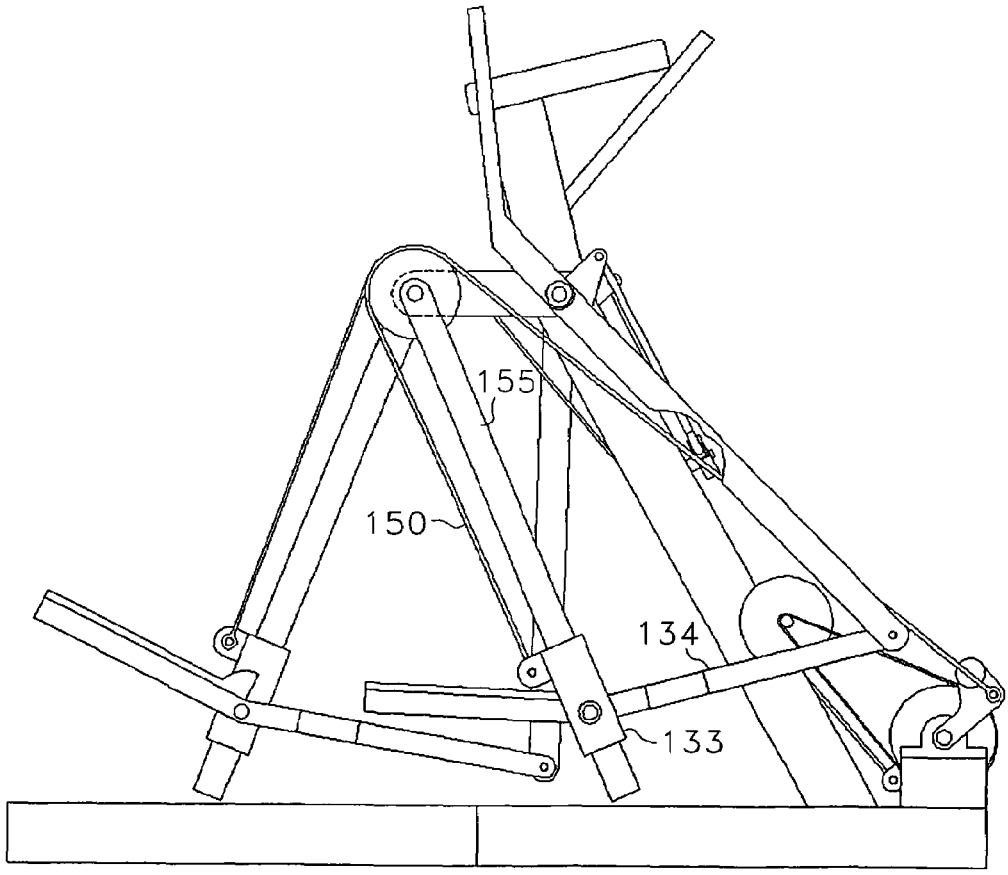
FIG. 7 depicts a side view of an embodiment of an exercise device.

FIG. 7 depicts the use of additional link components in a stationary exercise apparatus. In FIGS. 1, 2, 4, and 5, lateral positioning of foot support member 134 is performed by arcuate motion member 130 and by flexible element 150. Additional links may be utilized to enhance lateral positioning of foot support member 134. In FIG. 7, foot support member 134 includes pivoting collar 133. Positioning link 135 is coupled at one end to frame 101. At its other end, positioning link 135 slidably engages pivoting collar 133 and provides additional lateral positioning of foot support member 134 during operation. It will be understood that a lateral positioning linkage may have other arrangements, such as a combination of two or more links pivotally connected to one another with the end links being connected to a foot support member and a frame, respectively.

Figure 8:
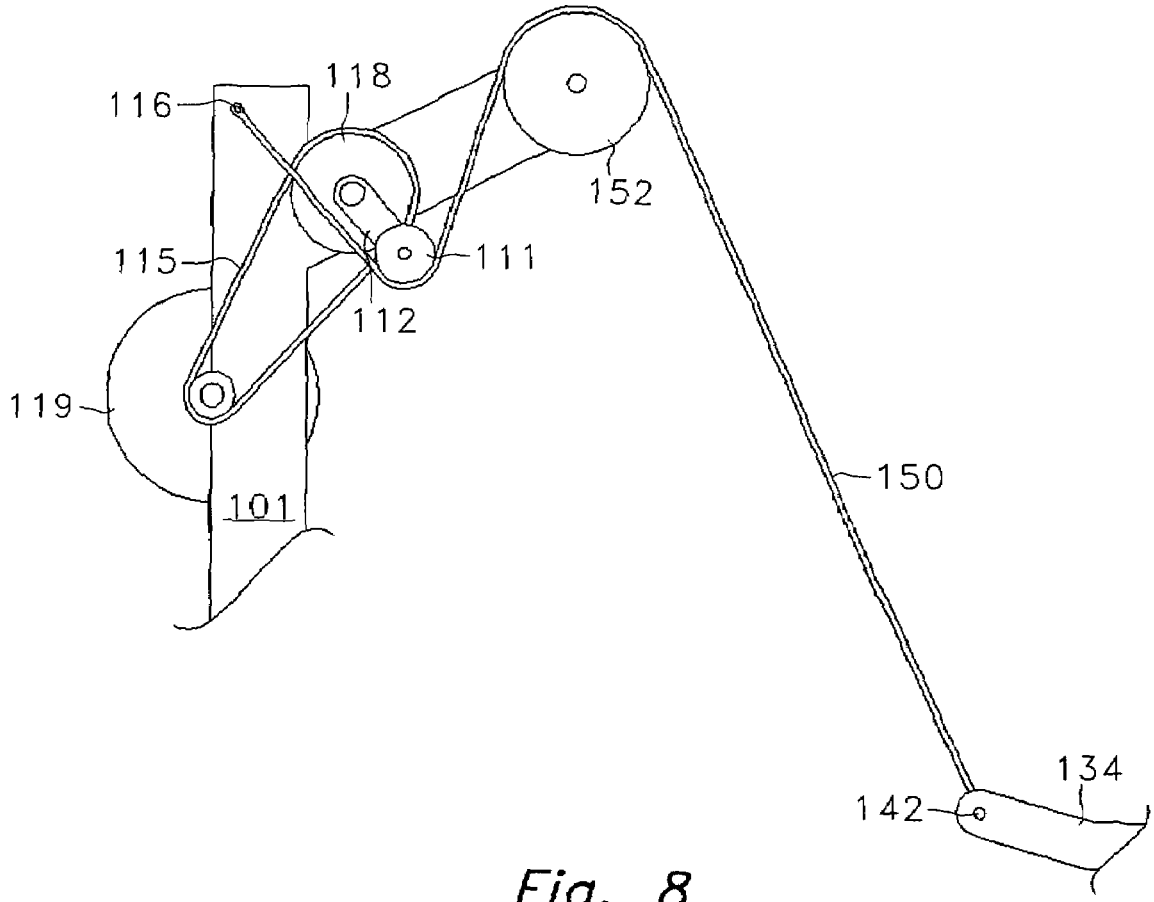
FIG. 8 depicts a side view of an embodiment of a crank system engaging a flexible element between a fixed attach point and a pulley.

FIG. 8 depicts an alternate method for coupling a flexible element to the crank system. For the purpose of simplification, only a portion of the frame from the embodiment in FIG. 1 is shown, and only the right side elements are shown. Crank arm 112 includes pulley 111. Flexible element 150 is coupled at one end to foot support member 134 at location 142 and at its other end to frame 101 at location 116. Between its two ends, flexible element 150 engages guide element 152 and pulley 111. As the crank system rotates, pulley 111 laterally displaces flexible element 152 between guide element 152 and location 116. This lateral displacement causes a lifting and lowering motion at location 142 on foot support member 134.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed:

1. A stationary exercise apparatus comprising:

a frame having a base portion adapted to be supported by a floor, a crank system comprising first and second crank arms and a brake/inertia device adapted to resist rotation of the crank system, the crank system being supported by the frame, a right linkage assembly comprising a right arcuate motion member pivotally coupled to the frame and a right foot support member having first and second portions, said first portion pivotally coupled to the right arcuate motion member, the right arcuate motion member oriented in a generally vertical position during use, the right foot support member oriented in a generally horizontal position during use, said right linkage assembly configured so that the right foot support member may move forward and rearward while the crank system remains stationary without rotation, a left linkage assembly comprising a left arcuate motion member pivotally coupled to the frame and a left foot support member having first and second portions, said first portion pivotally coupled to the left arcuate motion member, the left arcuate motion member oriented in a generally vertical position during use, the left foot support member oriented in a generally horizontal position during use, said left linkage assembly configured so that the left foot support member may move forward and rearward while the crank system remains stationary without rotation, and first and second coupling systems each comprising a flexible element, the first coupling system coupling the first crank arm to the second portion of the right foot support member and the second coupling system coupling the second crank arm to the second portion of the left foot support member;

wherein a user may undertake a walking, striding, jogging, or climbing motion; and wherein force may be applied by a user to the right and left foot support members permitting the user to vary among a climbing motion and a closed path walking, striding, or jogging motion, the length of the walking, striding, or jogging motion being instantaneously variable by the user when the user varies a forward and rearward force applied to the foot support members, while resistance is applied by the crank system.

2. The stationary exercise apparatus of claim 1, wherein at least one of the flexible elements partially supports the weight of one of the foot support members.

3. The stationary exercise apparatus of claim 1, wherein the right and left foot support members are close to horizontal than vertical throughout the entire motion of the members during the use of the apparatus.

4. The stationary exercise apparatus of claim 1, wherein the right and left arcuate members are closer to vertical than horizontal throughout the entire motion of the members during the use of the apparatus.

5. The stationary exercise apparatus of claim 1, wherein the right and left arcuate motion members are cross coupled so that motion of the right arcuate motion member causes an opposing motion of the left arcuate motion member.

6. The stationary exercise apparatus of claim 1, wherein the right and left arcuate motion members are cross coupled so that a forward or backward motion of the right arcuate motion member causes an opposing motion of the left arcuate motion member.

7. The stationary exercise apparatus of claim 1, wherein the range of motion of the arcuate motion members may be instantaneously varied by a user of the apparatus by applying a force to one or both of the foot support members.

8. The stationary exercise apparatus of claim 1, wherein at least one of the arcuate motion members comprises an upper portion that can be used as a handle to move the arcuate motion member.

9. The stationary exercise apparatus of claim 1, wherein the crank system is in front of a user of the apparatus.

10. The stationary exercise apparatus of claim 1, wherein the crank system is behind a user of the apparatus.

11. The stationary exercise apparatus of claim 1, wherein at least one of the coupling systems is coupled to the respective foot support member the behind a foot of a user.

12. The stationary exercise apparatus of claim 1, wherein at least one of the coupling systems is coupled to the respective foot support member the in front of a foot of a user.

13. The stationary exercise apparatus of claim 1, wherein at least one of the coupling systems is coupled to the respective foot support member near a foot of a user.

14. The stationary exercise apparatus of claim 1, wherein the crank system comprises a counterweight configured to inhibit at least one of the linkage assemblies from settling in a top dead center position.

15. The stationary exercise apparatus of claim 1, further comprising a pulley coupled to the frame, wherein the flexible element engages the pulley between the respective foot support member and the respective crank arm, wherein the pulley bears a portion of the weight of the foot support member.

16. The stationary exercise apparatus of claim 1, wherein at least one of the coupling systems comprises:

a rotating member rotatably coupled to the frame, a first flexible element coupled between the rotating member and one of the foot support members, and a second flexible element coupled between the rotating member and the respective crank arm, wherein motion of the crank arm causes rotation of the rotating member, and wherein rotation of the rotating member moves the foot support member.

17. The stationary exercise apparatus of claim 1, further comprising a lateral positioning linkage coupled between the frame and one of the foot support members, wherein the lateral positioning linkage is configured to at least partially determine a lateral position of the foot support member.

18. The stationary exercise apparatus of claim 1, further comprising:

a positioning link pivotally coupled to the frame, a collar pivotally coupled to one of the foot support members and slidably coupled to the positioning link, wherein the positioning link is configured to at least partially determine a lateral position of the foot support member.

19. The stationary exercise apparatus of claim 1, further comprising a pulley coupled to the frame, wherein one of the flexible elements is coupled to the frame at a first connection point and coupled to one of the foot support members at a second connection point, wherein the flexible element engages the pulley between the first connection point and the second connection point, wherein the crank arm is configured to engage the flexible element between the first connection point and the pulley, wherein the crank arm is configured to apply a force to the flexible element such that the flexible element lifts the foot support member.

20. A stationary exercise apparatus comprising:

a frame having a base portion adapted to be supported by a floor, a crank system comprising first and second crank arms and a brake/inertia device adapted to resist rotation of the crank system, the crank system supported by the frame, a right linkage assembly comprising a right arcuate motion member and a right foot support member, the right arcuate motion member comprising a first portion and a second portion, the first portion being above the second portion and coupled to the frame so that the right arcuate motion member may swing forward and rearward generally unconstrained by crank system rotation, the right foot support member oriented in a generally horizontal position during use and comprising a first portion and second portion, the first portion of the right foot support member being coupled to the second portion of the right arcuate motion member, a left linkage assembly comprising a left arcuate motion member and a left foot support member, the left arcuate motion member comprising a first portion and a second portion, the first portion being above the second portion and coupled to the frame so that the left arcuate motion member may swing forward and rearward generally unconstrained by crank system rotation, the left foot support member oriented in a generally horizontal position during use and comprising a first portion and a second portion, the first portion being coupled to the second portion of the left arcuate motion member, and first and second coupling systems each comprising a flexible support element, wherein the first coupling system couples the first crank arm to the second portion of the right foot support member and the second coupling system couples the second crank arm to the second portion of the left foot support member, wherein a user may apply force to the right and left foot support members permitting a climbing motion and a closed path walking, striding, or jogging motion; and wherein the user may instantaneously alter the length of the walking, striding, or jogging motion by altering the forward and rearward force applied to the foot support members, while resistance is applied by the crank system.

21. The stationary exercise apparatus of claim 20, wherein the range of motion of the arcuate motion members may be instantaneously varied by a user.

22. The stationary exercise apparatus of claim 20, wherein the first portion of each of the foot support members comprises the front end of the foot support member, and wherein the second portion of each of the foot support members comprises the back end of the foot support members.

23. The stationary exercise apparatus of claim 20, wherein the first portion of each of the foot support members comprises the back end of the foot support member, and wherein the second portion of each of the foot support members comprises the front end of the foot support members.

24. The stationary exercise apparatus of claim 20, further comprising:

a right pulley coupled to the right arcuate motion member, a left pulley coupled to the left arcuate motion member, and a belt arranged in a continuous loop on the right and left pulleys, wherein the belt cross couples the arcuate motion members so that motion of the right arcuate motion member causes an opposing motion of the left arcuate motion member.

25. The stationary exercise apparatus of claim 24, further comprising at least one idler pulley engaging the belt between the right and left pulleys.

26. The stationary exercise apparatus of claim 20, further comprising a pivoting linkage, wherein the pivoting linkage cross couples the left and right arcuate motion members.

27. The stationary exercise apparatus of claim 26, wherein the pivoting linkage comprises a rocker arm.

28. The stationary exercise apparatus of claim 20, further comprising:

first and second pulleys coupled to the frame, a belt arranged in a continuous loop on the pulleys, wherein the belt is coupled to the right at left foot support members, wherein the belt cross couples the foot support members so that motion of the right arcuate motion member causes an opposing motion of the left arcuate motion member.

29. A stationary exercise apparatus comprising:

a frame having a base portion adapted to be supported by a floor, a crank system comprising first and second crank arms, the crank system being supported by the frame, a right linkage assembly comprising a right foot support member and a right arcuate motion member pivotally coupled to the frame so that the right arcuate motion member may swing forward and rearward generally unconstrained by crank system rotation, a left linkage assembly comprising a left foot support member and a left arcuate motion member pivotally coupled to the frame so that the left arcuate motion member may swing forward and rearward generally unconstrained by crank system rotation, first and second coupling systems each comprising a flexible element, the first coupling system coupling the first crank arm to the right foot support member and the second coupling system coupling the second crank arm to the left foot support member;

means for inhibiting at least one of the linkage assemblies from settling into a locked top dead center position, wherein a user may undertake a walking, striding, jogging, or climbing motion and may instantaneously alter the length of the walking, striding, or jogging motion by altering the forward and rearward force applied to the foot support members, while resistance is applied by the crank system.

30. The stationary apparatus of claim 1, wherein the flexible element is a belt, a cable, or a chain.

31. The stationary apparatus of claim 20, wherein the flexible element is a belt, a cable, or a chain.

32. The stationary exercise apparatus of claim 29, wherein said inhibiting means comprises a counterweight operatively associated with the crank system.

33. The stationary apparatus of claim 29, wherein the flexible element is a belt, a cable, or a chain.

34. A stationary exercise apparatus comprising:

a frame having a base portion adapted to be supported by a floor, a crank system comprising first and second crank arms, each of said crank arms having a pulley, the crank system being supported by the frame, a right linkage assembly comprising a right foot support member and a right arcuate motion member pivotally coupled to the frame so that the right arcuate motion member may swing forward and rearward generally unconstrained by crank system rotation, a left linkage assembly comprising a left foot support member and a left arcuate motion member pivotally coupled to the frame so that the left arcuate motion member may swing forward and rearward generally unconstrained by crank system rotation, first and second coupling systems each comprising a flexible element coupled to the frame at one end of the flexible element, the first coupling system coupling the pulley of the first crank arm to the right foot support member and the second coupling system coupling the pulley of the second crank arm to the left foot support member;

wherein a user may undertake a walking, striding, jogging, or climbing motion and may instantaneously alter the length of the walking, striding, or jogging motion by altering the forward and rearward force applied to the foot support members, while resistance is applied by the crank system.

* * * * *